US005989639A

United States Patent [19]

Person

[11] Patent Number: 5,989,639

[45] Date of Patent: Nov. 23, 1999

[54] ANILOX COATER WITH BRUSH

[76] Inventor: Steven M. Person, 1432 Ballard Rd, Seagoville, Tex. 75159

[21] Appl. No.: 08/222,547

[22] Filed: Apr. 1, 1994

Related U.S. Application Data

[62] Division of application No. 08/078,427, Jun. 17, 1993, Pat. No. 5,425,809.

[51] Int. Cl.[6] ..... B05D 3/12

[52] U.S. Cl. ..... 427/356; 427/368; 427/444; 118/261; 118/262; 118/264

[58] Field of Search ..... 427/356, 368, 427/444; 118/261, 109, 262, 264

[56] References Cited

U.S. PATENT DOCUMENTS

| | | | |
|---|---|---|---|
| 4,158,333 | 6/1979 | Navi . | |
| 4,263,848 | 4/1981 | Matalia et al. . | |
| 4,538,541 | 9/1985 | Zimmer | 118/258 |
| 4,821,541 | 4/1989 | Bruno | 118/261 |
| 4,821,672 | 4/1989 | Bruno . | |
| 4,982,660 | 1/1991 | Hamm et al. . | |
| 5,111,747 | 5/1992 | Kobler et al. . | |
| 5,140,901 | 8/1992 | John . | |
| 5,176,077 | 1/1993 | DeMoore et al. . | |

*Primary Examiner*—Shrive Beck
*Assistant Examiner*—Bret Chen
*Attorney, Agent, or Firm*—Locke Liddell & Sapp LLP

[57] ABSTRACT

Air bubbles which are entrapped within the cells of an engraved applicator roller are displaced from the cells by wiping the surface of the engraved applicator roller with the bristles of a brush. An elongated brush mounted on a doctor blade head projects into a doctor blade reservoir. The bristles of the brush are disposed for wiping engagement against the engraved surface of an applicator roller which is wetted by liquid coating material. As the engraved applicator roller rotates in contact with the liquid material in the doctor blade reservoir, the bristles of the brush puncture the entrapped air bubbles and sweep the entrapped air away from the cells. The sweeping action of the bristles induces a relatively low pressure condition within the cells, which promotes the flow of liquid material into the cells. The elongated brush, which extends from one end of the doctor blade head to the other, serves as a baffle which blocks the transfer of dispersed air bubbles from the liquid material in the upper reservoir chamber above the brush to the lower reservoir chamber below the brush where the cells are being filled.

7 Claims, 5 Drawing Sheets

ANILOX COATER WITH BRUSH

CROSS REFERENCE TO RELATED APPLICATION

This is a division of application Ser. No. 08/078,427, filed 06/17/93 now U.S. Pat. No. 5,425,890.

FIELD OF THE INVENTION

This invention relates generally to sheet-fed or web-fed, rotary offset or flexographic printing press equipment, and in particular to an improved coating apparatus for supplying inks or protective and/or decorative coatings from a reservoir to a plate cylinder or to a blanket cylinder.

BACKGROUND OF THE INVENTION

Fluid metering or applicator rollers, commonly referred to as "anilox rollers", are used in the printing industry to transfer measured amounts of printing ink or a protective and/or decorative liquid coating to a plate cylinder or to a blanket cylinder. The surface of the applicator roller is engraved with an array of closely spaced, shallow depressions referred to as "cells". Ink or liquid coating material flows into the cells as the anilox roller turns within a reservoir. The engraved transfer surface of the applicator roller is scraped with a doctor blade to remove excess ink or liquid coating material. The ink or liquid coating material remaining on the anilox roller is contained within the cells. The plate cylinder or blanket cylinder transfers ink or liquid coating material from the cells of the anilox roller over all or a portion of the surface of printed sheets or a web of material, either plastic or paper, onto which the desired image is imprinted.

The anilox roller has a cylindrical surface and may be constructed in various diameters and lengths containing cells of various sizes and shapes. The volumetric capacity of an anilox roller is established during manufacturing and is dependent upon the selection of cell size, shape and number of cells per unit area. Depending upon the intended application, the cell pattern may be fine (many small cells per square inch) for lower coating weight jobs, for example UV coatings, or coarse (fewer large cells per square inch) for applying a protective coating or an adhesive coating to heavy stock.

DESCRIPTION OF THE PRIOR ART

Applicator rollers are journaled for rotation about an axis parallel with the rotary axis of a plate cylinder or blanket cylinder. A doctor blade head is extendable and retractable into and out of operative engagement with the applicator roller. In the operative position, the periphery of the applicator roller extends into an elongated reservoir cavity within the doctor blade head. The doctor blade head may have one, two or more doctor blades which seal against the cylindrical anilox surface and enclose the reservoir. Some doctor blades seal against an ink roller to form the bottom of an ink reservoir, while other doctor blades are used for doctoring the thickness of the liquid film on the applicator roller, in a reverse angle orientation.

A limitation on the performance of engraved applicator rollers is the entrapment of small air bubbles within the engraved cells. The entrapped air limits the amount of ink or other liquid media flowing into the cells. The entrapped air within the cell prevents the cell walls from becoming completely wetted with the ink or liquid coating material, and must be displaced before the cell can be filled.

Generally, the amount of air entrapped within the anilox cells is proportional to press speed, the flow characteristics of the liquid media, and the speed of rotation of the applicator roller within the reservoir. The faster the speed of rotation, the more air is entrapped, due to the inertia of the layer of air which adheres to the surface of the rotating applicator roller. The entrapped air causes starvation and uneven replenishment of liquid material; the ink or protective coating material is unable to fill the anilox cells in those areas where air bubbles have been entrapped. Moreover, the quality of the print and/or protective coating is compromised by starvation of the anilox cells. One method for overcoming the starvation condition caused by entrapment of air bubbles pulled in by the exposed peripheral surface of the applicator roller is to reduce the press speed until uniform inking or coating is achieved.

Another source of uneven filling of ink into the anilox cells is the presence of entrapped air bubbles in the ink or liquid material within the reservoir. Ambient air pulled in by the rotating anilox roller becomes mixed with the ink or liquid coating material. The entrapped air bubbles become dispersed as an air emulsion throughout the reservoir because of the turbulence produced by rotation of the peripheral surface of the anilox roller within the doctor reservoir cavity. The entrapped air bubbles are typically larger than the cell diameter, and oppose wetting contact of the ink or liquid coating material with the cell sidewall surfaces. Good wetting contact is essential so that the cells will be filled by capillary flow.

Various baffle arrangements have been proposed for separating the entrapped air bubbles from the ink or liquid coating material. Such attempts involve venting a portion of the entrapped air from the reservoir prior to scraping with the doctor blade, as well as transversely partitioning the reservoir to reduce turbulent movement of the ink or liquid coating material.

The prior methods for reducing the effects of entrapped air have not been entirely satisfactory, with a reduction in press speed being required for uniform inking and coating. It will be appreciated that some press jobs must be operated at relatively high speeds, for example, on the order of 1,000 linear feet per minute, to be profitable to the press operator. Moreover, to remain competitive, such jobs must be of the highest quality. Consequently, there is a continuing interest in providing an improved inker or coater in which liquid ink or liquid coating material can be transferred uniformly from a reservoir to a plate cylinder or blanket cylinder, without imposing a limitation on the press running speed.

SUMMARY OF THE INVENTION

The present invention provides an improved coating apparatus for applying a protective and/or decorative coating and/or inking to the surface of a freshly printed sheet or web in a sheet-fed or web-fed, offset rotary or flexographic printing press which is highly reliable and effective in use.

Air bubbles which are entrapped within the cells of an engraved applicator roller are displaced from the cells by wiping the surface of the engraved applicator roller with a fluid permeable brush. For this purpose, an elongated brush is mounted within the reservoir cavity of a doctor blade head. The doctor blade head includes an elongated cavity defining a reservoir for receiving ink or liquid coating material from a supply. The elongated brush is disposed within the reservoir cavity and engages the applicator roller. In one embodiment, the brush has an array of resilient bristles which are disposed for wiping engagement against the engraved surface of the applicator roller when the doctor blades are sealed against the applicator roller in the operative position. In an alternative embodiment, the brush is an elongated body of open cell foam. The brush may be mounted on the doctor blade head, or on a doctor blade.

As the engraved applicator roller rotates in contact with the liquid material in the doctor blade reservoir, the bristles of the brush puncture the entrapped air bubbles and sweep the entrapped air away from the cells. The bristles of the brush are wetted with the liquid material in the reservoir, and liquid material carried on the tips of the bristles wets the cell entrances, which promotes filling by capillary flow. The bristle tips also break the airlocks in the individual cells. Because of the sweeping action of the bristles as the entrapped air bubbles are punctured and swept away, a relatively low pressure condition is established within the cells. The low pressure differential condition promotes the flow of liquid material into the cells.

The bristles of the brush also break up entrapped air bubbles which are dispersed through the liquid material in the reservoir. Additionally, the elongated brush, which extends from one end of the doctor blade head to the other, serves as a baffle which blocks the transfer of dispersed air bubbles from the liquid material in the upper reservoir chamber above the brush to the lower reservoir chamber below the brush where the cells are being filled.

Operational features of the invention will be understood from the following detailed description taken in conjunction with the accompanying drawings which disclose, by way of example, the principles of the invention.

BRIEF DESCRIPTION THE DRAWINGS

DETAILED DESCRIPTION OF THE PREFERRED EMBODIMENT

Figure 1:
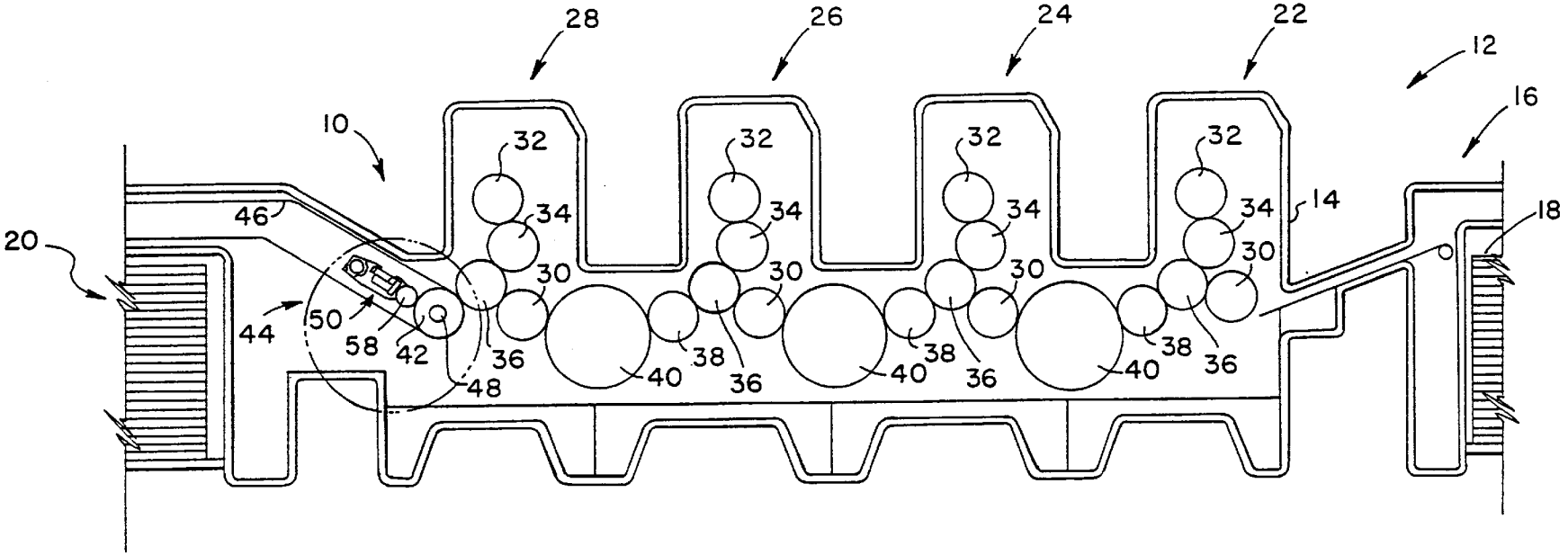
FIG. 1 is a schematic side elevational view of a sheet-fed, rotary offset printing press having an improved coating apparatus constructed according to the present invention.

As shown in the exemplary drawings, the present invention is embodied in a new and improved in-line doctor blade apparatus, herein generally designated 10, for use in applying a protective and/or decorative coating or inks to the freshly printed surface of sheets in a sheet-fed or web-fed, rotary offset or flexographic printing press, herein generally designated 12. In this instance, as shown in FIG. 1, the doctor blade coating apparatus 10 is illustrated as installed in a four color printing press 12, such as that manufactured by Heidelberger Druckmaschinen AG of the Federal Republic of Germany under its designation Heidelberg Speedmaster 102 V (40" or 102 cm), and which includes a press frame 14 coupled at one end, herein the right end, with a sheet feeder 16 from which sheets, herein designated 18, are individually and sequentially fed into the press, and at the opposite end, with a sheet delivery stacker 20 in which the finally printed sheets are collected and stacked. Interposed between the sheet feeder 16 and the sheet delivery stacker 20 are four substantially identical sheet printing units 22, 24, 26 and 28 which can print different color inks onto the sheets as they are moved through the press 12.

As illustrated, each of the printing units 22, 24, 26 and 28 is substantially identical and of conventional design, herein including a sheet transfer cylinder 30, a plate cylinder 32, a blanket cylinder 34 and an impression cylinder 36, with each of the first three printing units 22, 24 and 26 having a transfer cylinder 38 disposed to withdraw the freshly printed sheets from the adjacent impression cylinder and transfer the freshly printed sheets to the next printing station via a transfer cylinder 40. The final printing station 28 herein is shown as equipped with a delivery cylinder 42 which functions to support the printed sheet 18 as it is moved from the final impression cylinder 36 by a delivery conveyor system, generally designated 44, to the sheet delivery stacker 20.

Figure 2:
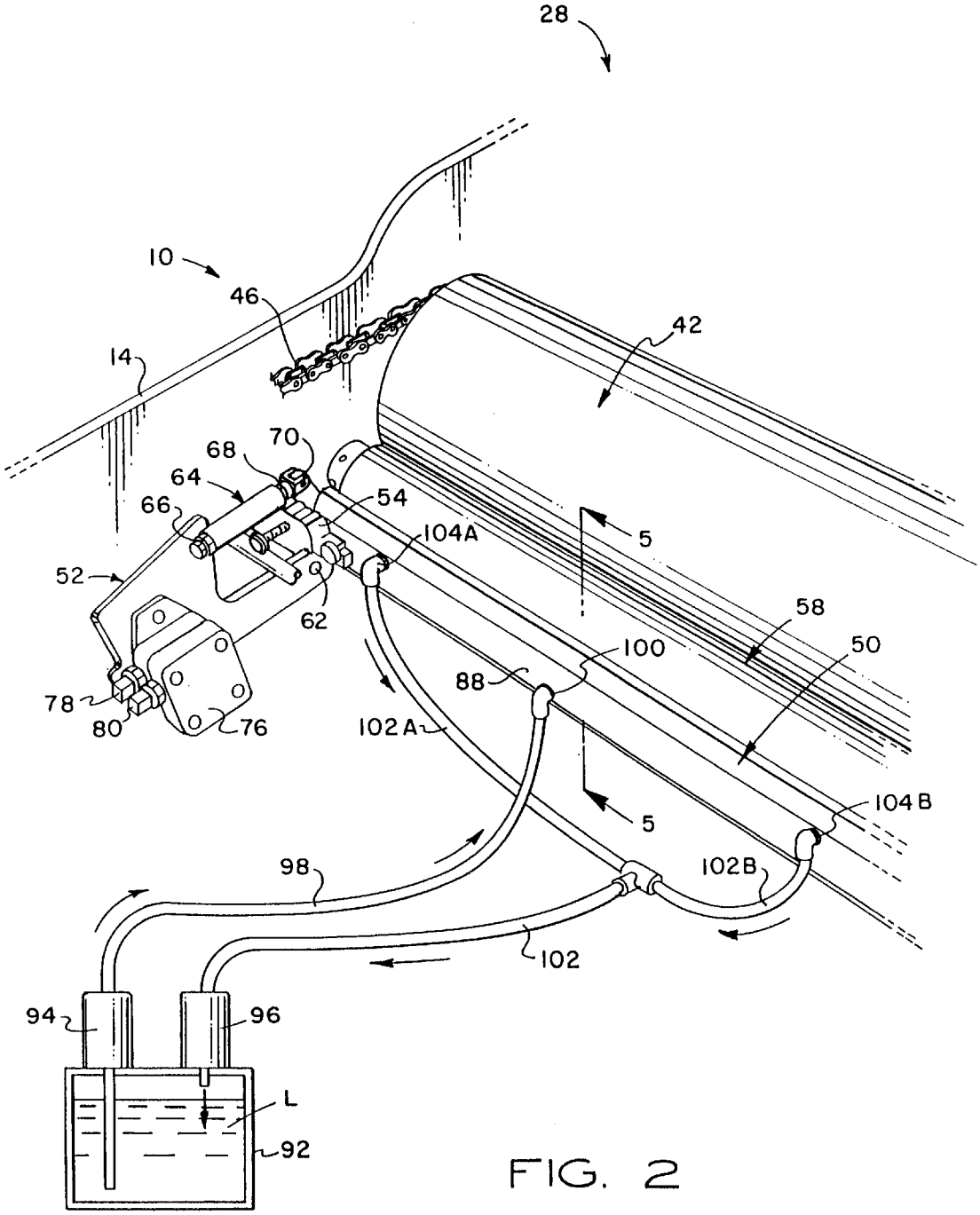
FIG. 2 is a fragmentary perspective view showing one side of the coating apparatus mounted in the press of FIG. 1 and illustrating the fluid path of coating material from a remote supply drum to the doctor blade reservoir of the coating unit.

The delivery conveyor system 44 as shown in FIG. 2 is of conventional design and includes a pair of endless delivery gripper chains 46, only one of which is shown carrying laterally disposed gripper bars having gripper elements used to grip the leading edge of a sheet 18 after it leaves the nip between the delivery cylinder 42 and impression cylinder 36 of the last printing unit 28. As the leading edge E of the sheet 18 is gripped by the grippers, the delivery chains 46 pull the sheet away from the impression cylinder 36 and convey the freshly printed sheet to the sheet delivery stacker 20 where the grippers release the finally printed sheet.

The endless delivery chains 46 are driven in synchronous timed relation to the impression cylinder 36 by sprocket wheels fixed adjacent the lateral ends of a delivery drive shaft 48 which has a mechanically geared coupling (not shown) to the press drive system. The delivery drive shaft 48 extends laterally between the sides of the press frame 14 adjacent the impression cylinder 36 of the last printing unit 28, and is mounted in parallel with the axis of the impression cylinder 36. In this instance, the delivery cylinder 42, which is constructed to allow adjustments in diameter by suitable means, is attached to the delivery drive shaft 48 so that the delivery cylinder 42 is also rotated in precise timed relation with the impression cylinder.

In this respect, it is important to note that when the freshly printed sheets 18 are conveyed away from the impression cylinder 36 of the final printing unit 28 by the grippers carried by the delivery chains 46, the wet inked surfaces of the sheets face the delivery drive shaft 48 and the sheets must be supported such that the ink is not smeared as the sheets are transferred. Typically, such support is provided by skeleton wheels or cylinders mounted to the press delivery drive shaft 48, or as is now more commonly used anti-marking, net-equipped delivery and transfer cylinders marketed by Printing Research, Inc. of Dallas, Tex. under its registered trademark SUPERBLUE. That system, which is made and sold under license, is manufactured in accordance with and operates as described in U.S. Pat. No. 4,402,267 to Howard W. DeMoore, the disclosure of which is incorporated herein by reference.

More recently, vacuum transfer apparatus of the type disclosed in U.S. Pat. No. 5,127,329 entitled "Vacuum Transfer Apparatus for Sheet-Fed Printing Presses", to Howard W. DeMoore which is also incorporated herein by reference, has been used. The vacuum transfer apparatus disclosed in that application can be used in place of delivery cylinders or skeleton wheels to transfer the unprinted side of the sheet away from the delivery drive shaft 48 so that the wet ink surface of the sheets do not come into contact with any press apparatus.

In accordance with the present invention, the in-line doctor blade coating apparatus 10 for applying the protective or decorative coating to the sheets 18 enables the press 12 to be operated in the normal manner and at high speed without the loss of the final printing unit 28, and without requiring any substantial press modifications by employing the existing press delivery drive shaft 48 as the mounting location for the coating applicator 10.

In presses having delivery systems such as skeleton wheels mounted on the delivery drive shaft 48 or a vacuum transfer apparatus as disclosed in U.S. Pat. No. 5,127,329, conversion to a coating operation can be quickly and easily achieved by mounting on the press delivery drive shaft 48 in place of the skeleton wheels or in addition to the vacuum transfer apparatus, a suitable delivery transfer cylinder 42 capable of performing the combined function of a blanket cylinder and a delivery transfer cylinder. By utilizing the delivery cylinder 42 mounted on the delivery drive shaft 48 to also act as a blanket cylinder, protective coating will be applied to the printed sheet 18 in precise timed registration, and will permit the press to be operated with its full range of printing units and applying coating without giving up a printing unit.

Toward these ends, the coating apparatus 10 of the present invention includes a relatively simple, positive acting and economical doctor blade coating unit, generally designated 50, mounted to the press frame 14 downstream of the delivery drive shaft 48 and positioned to apply liquid coating material to the blanket surface of a delivery cylinder 42 mounted on the delivery drive shaft. As can best be seen in FIG. 2, the doctor blade coating unit 50 is supported on a pair of side frames 52, only one of which is shown, it being understood that the other side frame is substantially the same as that of the side frame illustrated, attached to each side of the press frame 14. Pivotally mounted to one end of each side frame 52 is a support bracket 54 carrying one end of the doctor blade coating unit 50 and cooperating liquid material applicator roller 58 each disposed to extend laterally across the press 12 parallel with the delivery drive shaft 48. The coating unit 50 is mounted between the upper and lower runs of the delivery chains 46 downstream of the delivery drive shaft 48, and positioned so that the outer peripheral surface 60 of the applicator roller 58 is engageable against the coating blanket transfer surface of a delivery blanket cylinder 42 mounted on the delivery drive shaft 48.

As shown in FIG. 2, the support bracket 54 is pivotally attached to the end of the side frame 52 by a shaft 62 disposed at the lower end portion of the bracket. The assembly is pivoted about the shaft 62 by an extensible power cylinder 64, herein shown as a pneumatic cylinder, one end 66 of which is secured to the side frame 52, and the opposite end 68 of which is coupled through a pivot shaft 70 to the upper end portion of the bracket. By extending or retracting the pneumatic cylinder 64, the engagement pressure of the coating applicator roller 58 against the surface of the coating blanket cylinder 42 may be controlled, and the applicator roller may be completely disengaged from the coating blanket cylinder.

Figure 3:
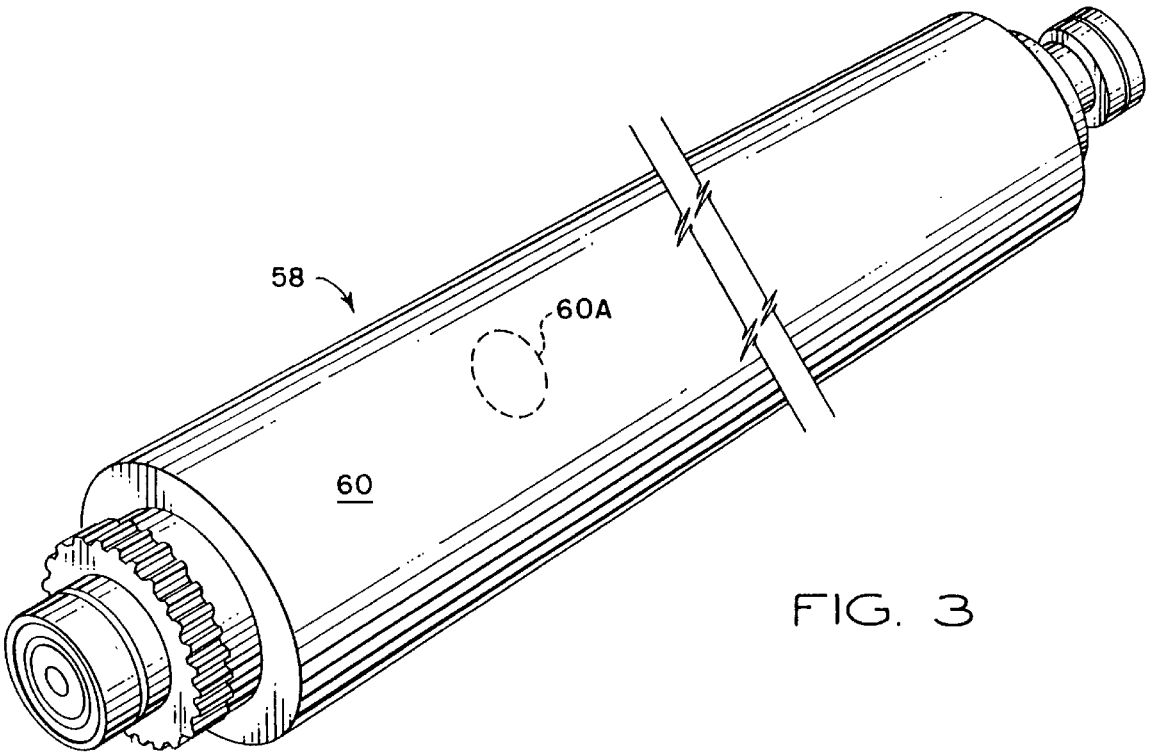
FIG. 3 is a fragmentary perspective view of an engraved applicator roller.
Figure 4:
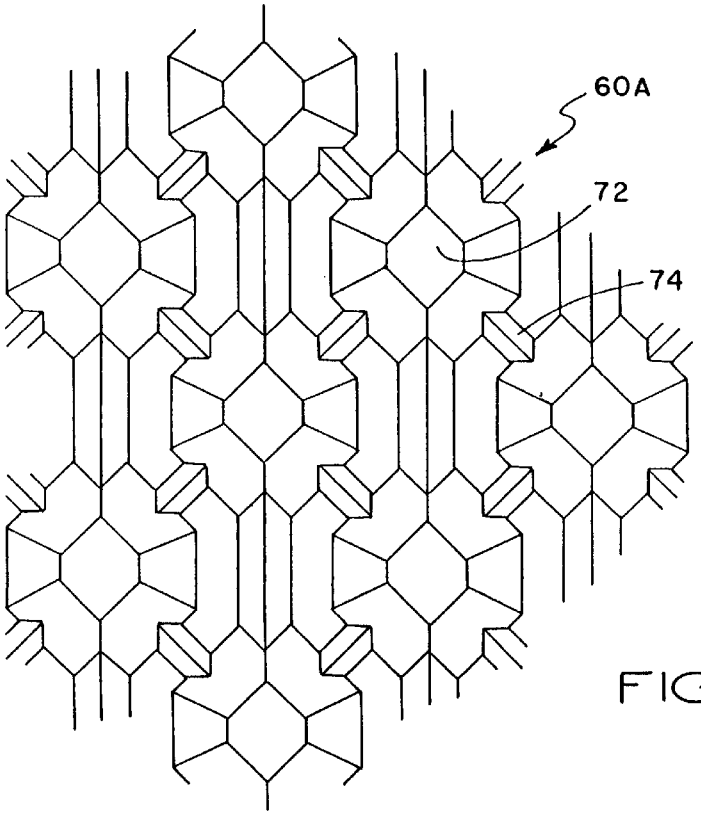
FIG. 4 is an enlarged view of the engraved cells which are formed on the transfer surface of the applicator roller of FIG. 3.

Referring now to FIG. 3 and FIG. 4, the coating applicator roller 58, which is of conventional design and preferably one such as the anilox engraved roller manufactured by A.R.C. International of Charlotte, N.C. and sold under the name "PRINTMASTER" having an engraved ceramic or chrome outer peripheral surface 60, is designed to pick up a predetermined uniform thickness of liquid coating material or ink from the reservoir of the doctor blade head 50, and then uniformly transfer the ink or coating material to the transfer surface of the blanket cylinder 42. The applicator roller 58 may also be used as an ink metering or transfer roller, which is used extensively in the flexographic printing trade to transfer closely controlled quantities of ink from fountain rollers running in an ink bath to a printing plate cylinder.

The transfer surface 60 of the applicator roller 58 is engraved to produce tiny depressions or cells 72 which extend uniformly over the surface of the applicator roller, with the aggregate volume of the cells defining a reservoir from which a liquid coating material is transferred onto the coating blanket cylinder. The cell configuration illustrated in FIG. 4 is hexagonal, with adjacent cells 72 being interconnected by channels 74.

To effect rotation of the pickup roller 58, a suitable motor 76, herein a hydraulic motor, is attached to one of the side frames 52 and coupled to a suitable hydraulic fluid source (not shown) through fittings 78, 80.

Figure 5:
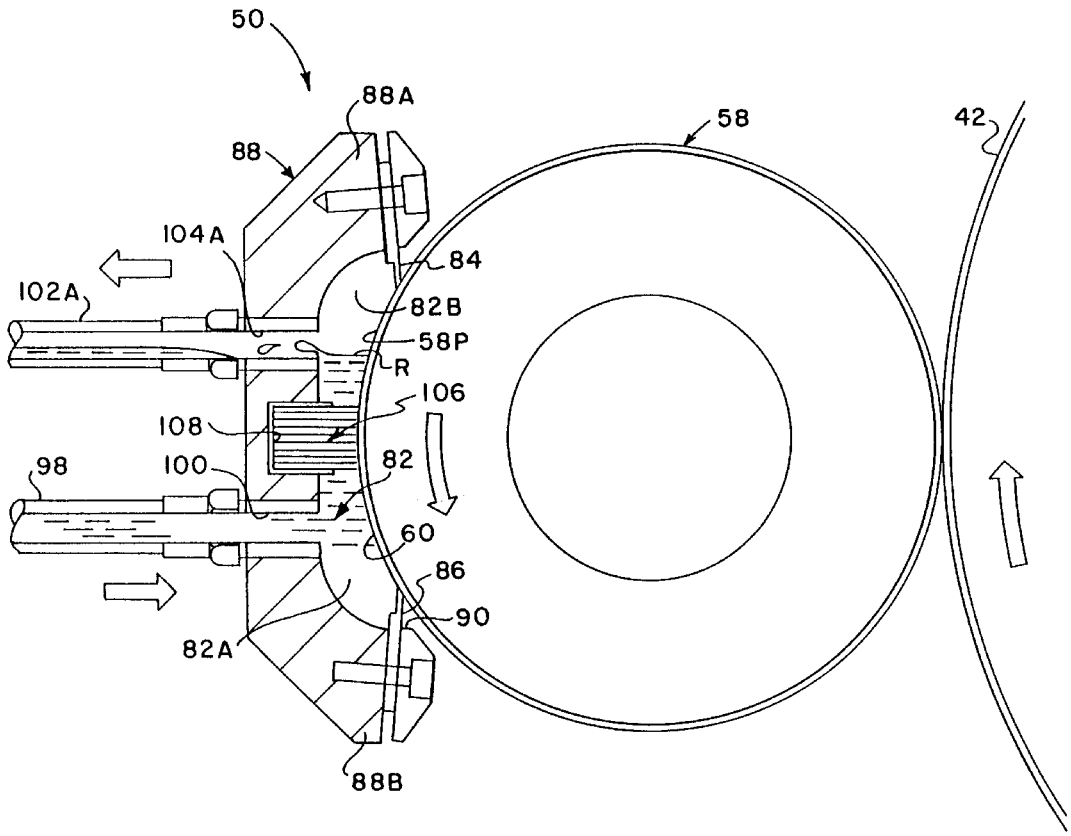
FIG. 5 is a sectional view of the coating apparatus and engraved applicator roller taken along the line 5—5 in FIG. 2.
Figure 6:
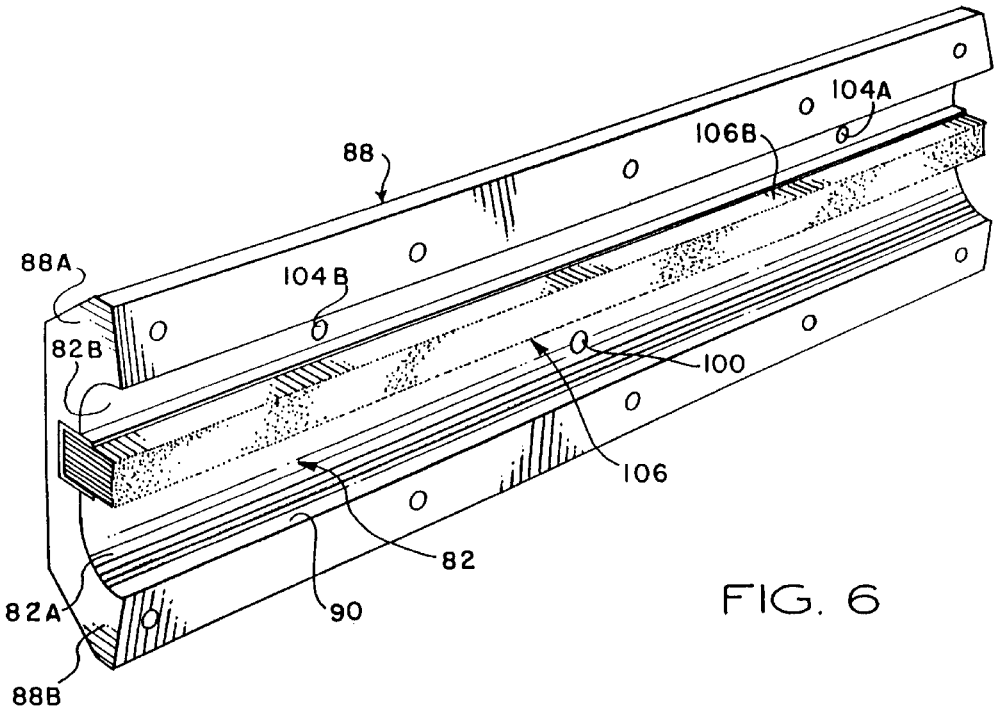
FIG. 6 is a perspective view of a doctor head, with doctor blades removed, and showing the installation of an elongated brush.

In the preferred embodiment, as can best be seen in FIG. 5, the pickup roller 58 has a peripheral surface portion 58P which projects radially into a doctor reservoir 82 containing the supply of liquid coating material or ink. A pair of upper and lower inclined doctor blades 84 and 86 attached to a doctor blade head 88 on shoulders 88A, 88B engage the applicator roller to doctor the excess liquid coating material or ink picked up from the reservoir by the engraved surface 60 of the roller. The reservoir cavity 88 is formed within the elongated doctor blade head 88 having a generally C-shaped cross-section with an opening 90 extending longitudinally along one side facing the pickup roller 58. The reservoir 82 is supplied with liquid material or ink from a supply drum 92 disposed in a remote location within or near the press 12. Preferably, the doctor blade head 88 is removably attached to the brackets 54, herein by bolts having enlarged, knurled heads, and which can be threaded through slots formed in the brackets to clamp the doctor blade head in place on the brackets.

To ensure that an adequate supply of liquid coating material is always present within the reservoir 82 and to prevent coagulation and clogging of the doctor blades 84 and 86 by the liquid coating material or ink, the coating material or ink is circulated through the reservoir 82 by two pumps 94 and 96 as shown in FIG. 2. Pump 94 draws the liquid material L from the supply drum 92 via a supply line 98 and discharges it into a bottom region of the reservoir 82 through a delivery port 100, and the other pump 96 acts to provide suction to a return line 102 by branch lines 102A, 102B, coupled adjacent a top region of the reservoir through return ports 104A, 104B for withdrawing excess liquid coating material or ink from the reservoir. By supplying the coating material or ink from the supply drum 92 at a greater rate than the rate of application of material by the applicator roller 58, a substantially constant supply of coating material or ink will always be present within the reservoir 82. The excess coating material or ink which rises above the liquid level of the return port 104 (FIG. 5) is suctioned away by the suction return pump 96.

The general arrangement of the pickup roller 58, doctor blades 84 and 86, and reservoir 82 is similar to that disclosed in U.S. Pat. No. 4,821,672 entitled "Doctor Blade Assembly With Rotary End Seals and Interchangeable Heads", the disclosure of which provides details concerning the end seal structure and operation of a pickup roller and reservoir usable with the present invention. According to an important feature of the present invention, however, the doctor blade reservoir 82 is not pressurized as taught by the prior art. Instead, coating liquid or ink is supplied to the doctor blade reservoir 82 by the suction flow produced by the pump 96, and assisted by the pump 94. In this arrangement, the suction pump 96 applies a vacuum or suction force in the reservoir which draws liquid material L from the supply through the supply conduit 98 to the reservoir. Excess liquid material L from the doctor blade reservoir 82 is returned through the return conduit 102 into the remote reservoir 92. The pump 94 assists the circulation of liquid coating material. A positive pressure condition within the doctor blade reservoir is avoided, and a below atmospheric vacuum pressure level is maintained.

Referring to FIG. 2, and FIG. 5, the liquid material is delivered into the lower region 82A of the doctor blade reservoir, and is withdrawn from an upper region 82B of the reservoir through the return conduits 102A, 102B. The liquid level elevation of the return ports is preferably selected to provide for the accumulation of liquid coating material or ink in slightly more than about half of the doctor blade chamber 82, thereby ensuring that the engraved surface 60 of the pickup roller 58 will be thoroughly wetted by the coating material or ink L as it turns through the doctor blade chamber 82. The reservoir 82 is bounded vertically by the lower and upper doctor head shoulders 88A, 88B. Accordingly, the return ports 104A, 104B and return lines 102A, 102B are located at a liquid level R intermediate the limits established by the lower and upper shoulders. Any excess liquid coating material or ink which rises above the liquid level R of the return ports will be suctioned away by the pump 96.

The auxiliary supply pump 94 provides positive flow input to the doctor blade reservoir 82 at a fixed flow rate. The return suction pump 96 has a faster suction flow rate than the supply flow rate. Consequently, a positive pressure buildup in the doctor blade reservoir 82 cannot occur. By utilizing two pumps as shown in FIG. 2, the liquid level within the doctor blade chamber 82 can be closely controlled, without positive pressure buildup, thereby reducing leakage through the end seals.

Referring to FIG. 5, it will be appreciated that the doctor blade chamber 82 is maintained at a pressure level below atmospheric by the suction action of the return suction flow pump 96. The coating liquid L rises to the liquid level of the return port R and is drawn off immediately by the suction pump 96. Additionally, air within the upper doctor blade chamber 82B is also evacuated, thereby reducing the doctor blade chamber pressure to a level below atmospheric.

As the engraved surface 60 of the applicator roller 58 rotates through the reservoir chamber 82, a layer of air adheres to the surface of the applicator roller and becomes entrapped within the cells 72. Ambient air is also drawn into the upper reservoir chamber 82 by rotation of the applicator roller 58. This ambient air becomes mixed with the ink or liquid coating material in the upper reservoir chamber 82B, and becomes dispersed as an air emulsion throughout the reservoir because of the turbulence produced by rotation of the peripheral surface of the applicator roller 58 within the doctor reservoir chamber 82.

According to the present invention, the entrapped air bubbles in the applicator roller cells are displaced from the cells by wiping the surface 60 of the engraved applicator roller 58 with the bristles 106B of an elongated brush 106. The elongated brush 106 is mounted within a rectangular channel 108 which intersects the doctor blade head 88 along its length. Preferably, the rectangular channel 108 is centered substantially between the elevation of the supply port 100 and the return ports 104A, 104B. In the operative position as shown in FIG. 5, the doctor blades 84, 86 are sealed against the engraved surface 60 of the applicator roller 58. Additionally, the bristles 106B of the brush 106 are disposed in wiping engagement of the engraved surface 60.

As the engraved applicator roller 58 rotates in contact with the liquid material in the doctor blade reservoir 82, the bristles 106B puncture the entrapped air bubbles and sweep the entrapped air away from the cells 72. The bristles of the brush 106 are wetted with the liquid material in the reservoir, and the liquid material on the tips of the brush wet the cell entrances, thereby promoting capillary flow. Because of the sweeping action of the bristles 106B as the entrapped air bubbles are punctured and swept away, a relatively low pressure condition is established in the cells as they pass by the brush. The low pressure differential flow through condition promotes the flow of liquid material into the cells. The bristles act as a pre-shear means for reducing the dynamic viscosity of the liquid material.

The bristles 106B of the brush also break up entrapped air bubbles which may be dispersed through the liquid material in the upper region 82B of the reservoir. The elongated brush 106, which extends from one end of the doctor blade head to the other, serves as a liquid permeable partition which blocks the transfer of dispersed air bubbles from the liquid material in the upper region 82B above the brush 106, and prevents transfer of the dispersed bubbles into the lower region 82A below the brush 106 in the region where the cells are being filled.

Transfer of dispersed air bubbles from the upper region 82B into the lower region 82A is also inhibited by maintaining a below atmospheric pressure level in the upper region 82B. Because liquid coating material is being fed into the lower region 82A, a slightly positive pressure differential arises across the brush 106 which opposes the migration of air bubbles from the upper region into the lower region.

Figure 7:
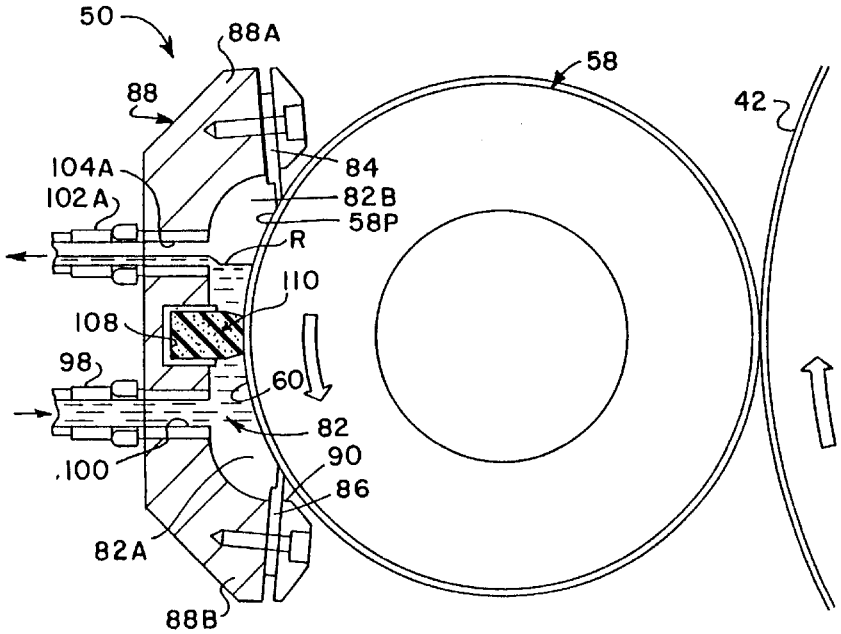
FIG. 7 is a view similar to FIG. 5 which illustrates the open cell foam brush embodiment of the present invention.
Figure 8:
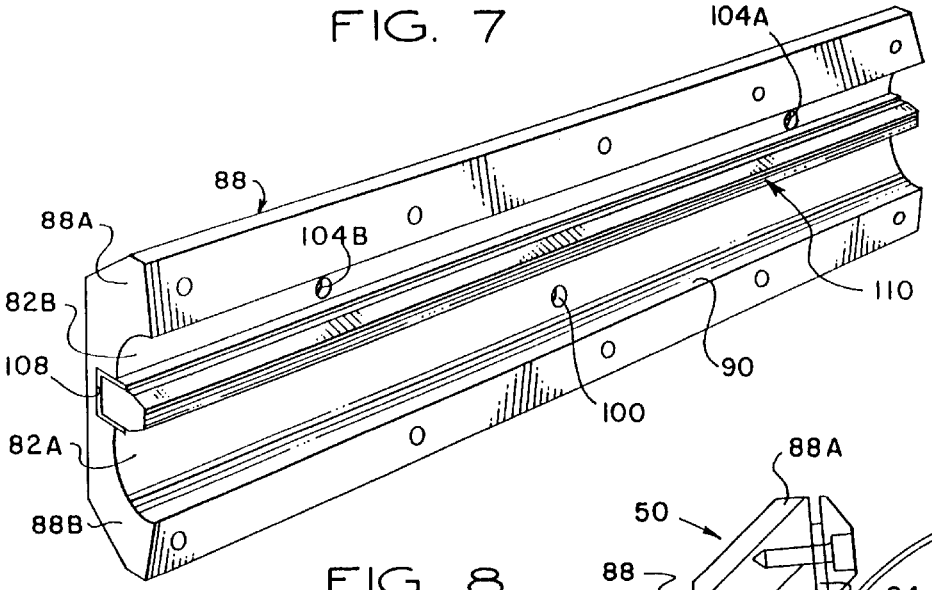
FIG. 8 is a view similar to FIG. 6 showing the installation of the open cell foam brush in the reservoir cavity of the doctor head; and, FIG. 9 is a sectional view similar to FIG. 7 showing an alternative mounting arrangement for the elongated brush embodiment.

Referring now to FIG. 7 and FIG. 8, an alternative embodiment of the fluid permeable wiping means is illustrated. In this alternative embodiment, the brush is an elongated, resilient block 110 of open-cell foam material. Suitable open-cell foam materials include polyurethane, plasticized polyvinylchloride and rubber, with the polyurethane foam being preferred. The open-cell foam block 110 is secured within the channel 108, and has an end portion disposed in wiping engagement with the engraved surface 60 of the applicator roller 58.

Preferably, the open-cell foam brush 110 is under compression in the operative position as shown in FIG. 7 to ensure clean wiping action. The density of the open-cell foam brush is selected in the range of from about one pound to about two pounds per cubic foot. The density of the open-cell foam brush 110 should be selected to provide a permeability which is compatible with the particular liquid coating material to permit excess liquid coating material to escape from the lower chamber 82A through the brush into the upper chamber 82B for return to the supply through the conduit 102A.

Figure 9:
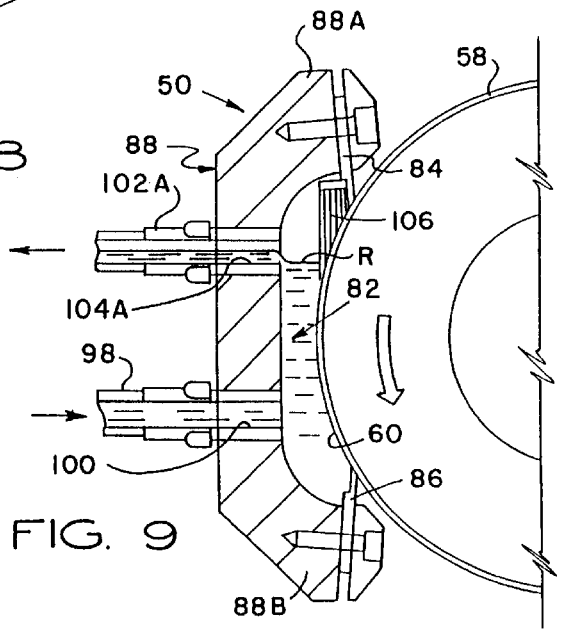

Yet another embodiment is illustrated in FIG. 9, in which the brush 106 is mounted on the upper doctor blade 84. In this arrangement, the bristles of the brush 106 wipe against engraved surface 60 of the applicator roller 58. The bristles puncture the entrapped air bubbles and sweep the entrapped air away from the engraved cells. Liquid coating material on the tips of the bristles wet the cell entrances thereby promoting capillary flow, as previously discussed in connection with the embodiment illustrated in FIG. 5.

In operation, the coater assembly is first locked into the operative position on the press frame with the doctor blades 84, 86 engaging the applicator roller 58. When the press is off impression, the hydraulic motor 76 rotates the applicator roller 58 as coating liquid material is pumped under pressure from the reservoir 92 into the lower region 82B within the doctor blade assembly. The liquid coating material spreads over the engraved surface of the applicator roller 58 and is metered by the lower doctor blade 86 during counterclockwise rotation as shown in FIG. 5. Liquid coating material is picked up by the engraved surface 60 of the applicator roller 58, and excess coating is returned to the supply reservoir 92 through the return conduit 102. According to this arrangement, sufficient flow of liquid coating material is maintained combined with the wiping action of the bristles to avoid clogging the flow conduits or the cells of the engraved roller with dried coating and to avoid starving the ends of the applicator roller.

When the press is on impression, pneumatic cylinders push the applicator roller 58 into engagement with the coating blanket cylinder 42 at a mechanically adjustable pressure level. The coating blanket cylinder 42 rotates in the direction as indicated by the arrow in engagement with the applicator roller 58. As the coating blanket cylinder 42 rotates, a metered amount of liquid coating material or ink is delivered to the coating blanket cylinder at the nip between the applicator roller 58 and the coating blanket cylinder 42. The coating blanket cylinder 42 in turn delivers the coating material or ink to the freshly printed surface of the sheet 18. When the unit is not in use, the applicator roller 58 is actuated away from the coating blanket cylinder 42.

As the cells of the engraved applicator roller are swept clean by the brush 106, liquid material is picked up quickly and uniformly across the engraved surface of the applicator roller. Thus starvation or drying of material in the engraved cells 72 does not occur, and a uniform layer of liquid material is picked up each time the applicator roller 58 rotates through the doctor blade reservoir 82. Because of the low pressure differential created within the cells by the sweeping action of the brush, the cells fill rapidly even at high press operating speeds. Moreover, because of the baffle action provided by the brush 106, air bubbles cannot be pumped from the upper region into the lower region. Consequently, clusters of air bubbles will not be established in the lower region of the doctor reservoir where the presence of such bubble clusters might cause cavitation and starvation of the engraved cells. The net result is that the engraved cells of the applicator roller are completely filled with liquid ink or liquid coating material, which is thereafter transferred uniformly to a plate cylinder or blanket cylinder. This is performed without imposing a limitation of the press running speed, and without streaking or otherwise compromising the quality of the coating transferred to a plate cylinder or a blanket cylinder.

From the foregoing, it should be apparent that the coating apparatus 10 of the present invention provides a highly reliable, effective and economical in-line apparatus for applying coating material uniformly to the freshly printed sheets 18 in a sheet-fed, offset rotary printing press 12. While a particular form of the present invention has been illustrated and described, it should be apparent that variations and modifications therein can be made without departing from the spirit and scope of the invention.

I claim:

1. A method for applying liquid material from a supply to an applicator roller comprising the steps:

providing a doctor blade head having an elongated cavity defining a reservoir for receiving liquid material from the supply;

partitioning the reservoir cavity into a first reservoir chamber and a second reservoir chamber with a fluid permeable member;

extending the applicator roller into the reservoir for wetting contact with liquid material contained therein;

inducing the flow of liquid material from the supply into the first reservoir chamber; and wiping excess liquid material from the applicator roller into the second reservoir chamber.

2. A method for applying liquid material as defined in claim 1, including the step:

wiping the surface of the applicator roller with a fluid permeable brush.

3. A method for applying liquid material as defined in claim 1, including the step:

suctioning air and excess liquid material from the second reservoir chamber thereby producing a positive pressure differential across the fluid permeable member for opposing migration of air bubbles from the second reservoir chamber into the first reservoir chamber.

4. A method for applying liquid material as defined in claim 1, including the step:

evacuating excess liquid material and air from the second reservoir chamber so that the chamber pressure within the second reservoir chamber is maintained at a level below atmospheric pressure.

5. A method for preventing the migration of air bubbles from a first chamber region of a reservoir to a second chamber region of the reservoir, comprising the step:

partitioning said reservoir with a fluid permeable member which defines a fluid permeable boundary between the first chamber region and the second chamber region.

6. A method as defined in claim 5, including the step of imposing a pressure differential across said fluid permeable member.

7. A method as defined in claim 5, including the steps:

supplying the first chamber region of the reservoir with liquid coating material; and maintaining a below-atmospheric pressure level in the second chamber region of the reservoir.

* * * * *